US011581619B2

(12) United States Patent
Wang et al.

(10) Patent No.: US 11,581,619 B2
(45) Date of Patent: Feb. 14, 2023

(54) DIELECTRIC WAVEGUIDE FILTER HAVING A PLURALITY OF RESONANT CAVITIES COUPLED BY WINDOW STRUCTURES CONFIGURED TO AFFECT THE ELECTRIC AND MAGNETIC FIELD DISTRIBUTIONS IN THE FILTER

(71) Applicant: SAMSUNG ELECTRONICS CO., LTD., Suwon-si (KR)

(72) Inventors: Ruoming Wang, Shenzhen (CN); Haiju Kang, Shenzhen (CN); Zhenkun Zhang, Shenzhen (CN); Bingjian Niu, Shenzhen (CN)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/059,123

(22) PCT Filed: Dec. 27, 2018

(86) PCT No.: PCT/KR2018/016772
§ 371 (c)(1),
(2) Date: Nov. 25, 2020

(87) PCT Pub. No.: WO2019/235708
PCT Pub. Date: Dec. 12, 2019

(65) Prior Publication Data

US 2021/0210829 A1 Jul. 8, 2021

(30) Foreign Application Priority Data

Jun. 5, 2018 (CN) ..... 201810567364.6

(51) Int. Cl.
*H01P 1/20* (2006.01)
*H01P 1/208* (2006.01)
*H01P 1/08* (2006.01)

(52) U.S. Cl.
CPC ..... *H01P 1/2002* (2013.01); *H01P 1/2088* (2013.01); *H01P 1/08* (2013.01)

(58) Field of Classification Search
CPC ..... H01P 1/2002; H01P 1/2088; H01P 3/121
(Continued)

(56) References Cited

U.S. PATENT DOCUMENTS 6,239,673 B1 5/2001 Wenzel et al.
2013/0249651 A1 9/2013 Wu et al.
(Continued)

FOREIGN PATENT DOCUMENTS

CN 201898182 U 7/2011
CN 105390779 A 3/2016
KR 10-1442220 B1 9/2014

OTHER PUBLICATIONS

International Search Report (PCT/ISA/210) and Written Opinion (PCT/ISA/237) dated Mar. 28, 2019, issued by the International Searching Authority in International Application No. PCT/KR2018/016772.

*Primary Examiner* — Benny T Lee
(74) *Attorney, Agent, or Firm* — Sughrue Mion, PLLC

(57) ABSTRACT

A dielectric waveguide filter includes first resonant cavities, which are connected to form upper resonant cavities, and second resonant cavities, which are connected to form lower resonant cavities, wherein the upper and lower resonant cavities are correspondingly overlapped; each of the first resonant cavities has a first window coupling structure, wherein the first window coupling structure includes a first window opened at a position where the magnetic field distribution of a high-order mode in each of the first resonant cavities is the weakest, and/or a second window opened at a position where the electric field distribution of the high-order mode in each of the first resonant cavities is the strongest; and each of the second resonant cavities has a
(Continued)

second window coupling structure corresponding to the first window coupling structure, and the first and second window coupling structures cooperate to eliminate the high-order modes of the dielectric waveguide filter.

12 Claims, 9 Drawing Sheets

(58) Field of Classification Search
USPC ..... 333/208
See application file for complete search history.

(56) References Cited

U.S. PATENT DOCUMENTS

| | | | | |
|---|---|---|---|---|
| 2016/0301378 | A1 | 10/2016 | Wang et al. | |
| 2016/0308264 | A1* | 10/2016 | Vangala | H01P 1/2002 |
| 2016/0336632 | A1* | 11/2016 | Rogozine et al. | H01P 1/2088 |
| 2018/0131059 | A1 | 5/2018 | Brannon et al. | |

* cited by examiner

B

DIELECTRIC WAVEGUIDE FILTER HAVING A PLURALITY OF RESONANT CAVITIES COUPLED BY WINDOW STRUCTURES CONFIGURED TO AFFECT THE ELECTRIC AND MAGNETIC FIELD DISTRIBUTIONS IN THE FILTER

TECHNICAL FIELD

The disclosure relates to the field of filters, in particular to a dielectric waveguide filter.

BACKGROUND ART

With the rapid development of wireless mobile communication technology, the requirements for the far-end out-of-band performance of dielectric waveguide filters have become increasing compared to the past. However, current dielectric waveguide filters inevitably have a problem of poor suppression and near harmonics in the high-order mode. In order to solve the problem, it is usually necessary to use multi-order low-pass filters to suppress high-order modes of the far-end out-of-band, and the additional low-pass filters increase area and insertion loss.

In order to further improve far-end suppression, cascading of a dielectric waveguide filter and a metal cavity may also be adopted. A harmonic of the far-end of the metal cavity is good, cascading of the metal cavity and the dielectric waveguide filter may improve the far-end suppression, however, the metal cavity occupies a large area, that causes it is difficult to achieve the same volume as the dielectric waveguide filter by the cascading manner.

In addition, a TEM (Transverse Electric and Magnetic Field) mode can also be used to improve the far-end suppression. The harmonic of the TEM mode is farther than that of a dielectric waveguide, but a Q value thereof is lower than that of the dielectric waveguide, and the performance thereof is poorer than that of the dielectric waveguide.

SUMMARY

The disclosure aims to provide a dielectric waveguide filter, and the far-end harmonic suppression and high-order mode suppression of the dielectric waveguide filter are improved by providing coupling structures aiming at high-order modes.

In order to achieve the object above, the present disclosure provides a dielectric waveguide filter, comprising:

a plurality of first resonant cavities and a plurality of second resonant cavities, wherein the plurality of first resonant cavities are connected to form upper resonant cavities, and the plurality of second resonant cavities are connected to form lower resonant cavities, and the upper resonant cavities and the lower resonant cavities are correspondingly overlapped;

wherein each of the plurality of first resonant cavities having a first window coupling structure, wherein the first window coupling structure comprises at least one of a first window opened in a surface of each of the plurality of first resonant cavities at a position where the magnetic field distribution of a first high-order mode in each of the plurality of first resonant cavities is the weakest, and/or a second window opened in the surface of each of the plurality of first resonant cavities at a position where the electric field distribution of the first high-order mode in each of the plurality of first resonant cavities is the strongest;

wherein each of the plurality of second resonant cavities having a second window coupling structure corresponding in position to the first window coupling structure, wherein the second window coupling structure comprises at least one of a third window opened in a surface of each of the plurality of second resonant cavities at a position where the magnetic field distribution of a first high-order mode in each of plurality of the second resonant cavities is the weakest, and/or a fourth window opened in the surface of each of the plurality of second resonant cavities at a position where the electric field distribution of the first high-order mode in each of the plurality of second resonant cavities is the strongest; and wherein the first window coupling structure and the second window coupling structure cooperate to eliminate coupling between the first high-order mode in each of the plurality of first resonant cavities and the first high-order mode in each of the plurality of second resonant cavities.

At least one of, at least one of the first window and the second window are located on a first surface of each of the plurality of first resonant cavities, and at least one of the third window and the fourth window are located on a second surface of each of the plurality of second resonant cavities.

The first surface and the second surface are arranged to be opposite to each other.

Two of at least one of the first window are located at centers of a pair of opposite edges of the first surface of each of the plurality of first resonant cavities, respectively, and two of at least one of the third window are located at centers of a pair of opposite edges of the second surface of each of the plurality of second resonant cavities, respectively; and the second window is ¼ of a side length away from the center of each of the plurality of first resonant cavities, and the fourth window is ¼ of a side length away from the center of each of the plurality of second resonant cavities.

The dielectric waveguide filter further comprises a feed structure for reducing the excitation of a second high-order mode, wherein the feed structure comprises a protrusion protruding from one side edge of one of the plurality of first resonant cavities or one of the plurality of second resonant cavities to the outside of one of the plurality of first resonant cavities or one of the plurality of second resonant cavities and a feed post arranged at the junction of one of the plurality of first resonant cavities or one of the plurality of second resonant cavities and the protrusion.

The dielectric waveguide filter comprises a first feed structure and a second feed structure.

The first feed structure includes a first protrusion protruding from one side edge of one of the plurality of first resonant cavities as an input cavity to the outside of one of the plurality of first resonant cavities.

The second feed structure includes a second protrusion protruding from one side edge of one of the plurality of second resonant cavities as an output cavity to the outside of one of the plurality of second resonant cavities.

The dielectric waveguide filter further comprises an adjacent cavity coupling spacer, connected between two adjacent first resonant cavities or between two adjacent second resonant cavities, wherein the adjacent cavity coupling spacer is located at the center of a pair of opposite sides of the two first resonant cavities or the two second resonant cavities, to reduce the coupling of the first high-order modes and the second high-order modes between the two adjacent first resonant cavities or between the two adjacent second resonant cavities.

The adjacent cavity coupling spacer does not coincide with the first windows or the third windows in position.

Each of the plurality of first resonant cavities is arranged symmetrically based on a center of each of the plurality of first resonant cavities to form the upper resonant cavities, and the plurality of second resonant cavities are arranged in the same manner as the arrangement of the upper resonant cavities to form the lower resonant cavities.

As can be seen from the technical contents above, the disclosure has the beneficial effects that:

(1) the window coupling structures aiming at suppression of first high-order modes are set in the dielectric waveguide filter of the present disclosure, and the first window coupling structures in the upper resonant cavities and the second window coupling structures in the lower resonant cavities are coupled to each other, reducing the inter-cavity coupling of the first high-order modes of the two resonant cavities connected between two adjacent layers, so as to realize the suppression of the first high-order modes;

wherein, the first window and the third window are both located at the positions where the corresponding main mode magnetic field distribution is the strongest and the corresponding first high-order mode magnetic field distribution is the weakest, thus the magnetic coupling between the first high-order modes is minimized while ensuring main mode coupling; meanwhile, the coupling between the second window and the fourth window corresponding to the positions where the electric field distribution of the first high-order modes is the strongest forms electrical coupling, which increases the electrical coupling between the first high-order modes, thereby counteracting the magnetic coupling formed between the first window and the third window, which further reducing the inter-cavity coupling of the first high-order modes, thereby inhibiting the transmission of the first high-order modes, and thus achieving the purpose of improving the suppression of the first high-order modes by the filter;

(2) the feed structure of the present disclosure reduces the excitation of the second high-order modes from the source, thereby increasing the suppression of the second high-order modes;

(3) the coupling spacer of two adjacent resonant cavities in the same layer may reduce the coupling between the first high-order modes and the second high-order modes of the adjacent two resonant cavities; and (4) the combination of the window coupling structures, the feed structure and the adjacent cavity coupling spacer may cut off multiple groups of coupling paths between two high-order modes closest to the fundamental mode, i.e. the coupling between the high-order modes is reduced, thus comprehensively improving the suppression of the high-order modes by the dielectric waveguide filter.

DETAILED DESCRIPTION

In order to make the purpose, technical contents and advantages of the present disclosure clearer, some embodiments of the present disclosure will be described in detail below with reference to the accompanying drawings. It should be understood that the embodiments described herein are only for the purpose of explaining the present disclosure and are not intended to limit the present disclosure.

The disclosure aims to provide a dielectric waveguide filter, and the far-end harmonic suppression of the dielectric waveguide filter and the suppression range are increased by providing coupling structures aiming at suppression of high-order modes.

It should be noted that, each of the plurality of first resonant cavities 10 has its own first high-order mode and second high-order mode, and the first high-order mode and second high-order mode of each of the plurality of first resonant cavities 10 refer to two high-order modes closest to its own fundamental mode. Similarly, each of the plurality of second resonant cavities 20 has its own first high-order mode and second high-order mode, and the first high-order mode and second high-order mode of each of the plurality of second resonant cavities 20 refer to the two high-order modes closest to its own fundamental mode.

In order to clearly explain the technical contents of the present application, a plurality of first resonant cavities 10 and a plurality of second resonant cavities 20 have the same structure and shape herein, so the first high-order modes herein are all the same and the second high-order modes herein are all the same, while the first high-order modes and the second high-order modes are two different high-order modes. Of course, the present disclosure does not restrict whether the plurality of first resonant cavities 10 and the plurality of second resonant cavities 20 of the dielectric waveguide filter have the same structure and shape, and whether the first high-order modes and the second high-order modes are the same.

Figure 1A:
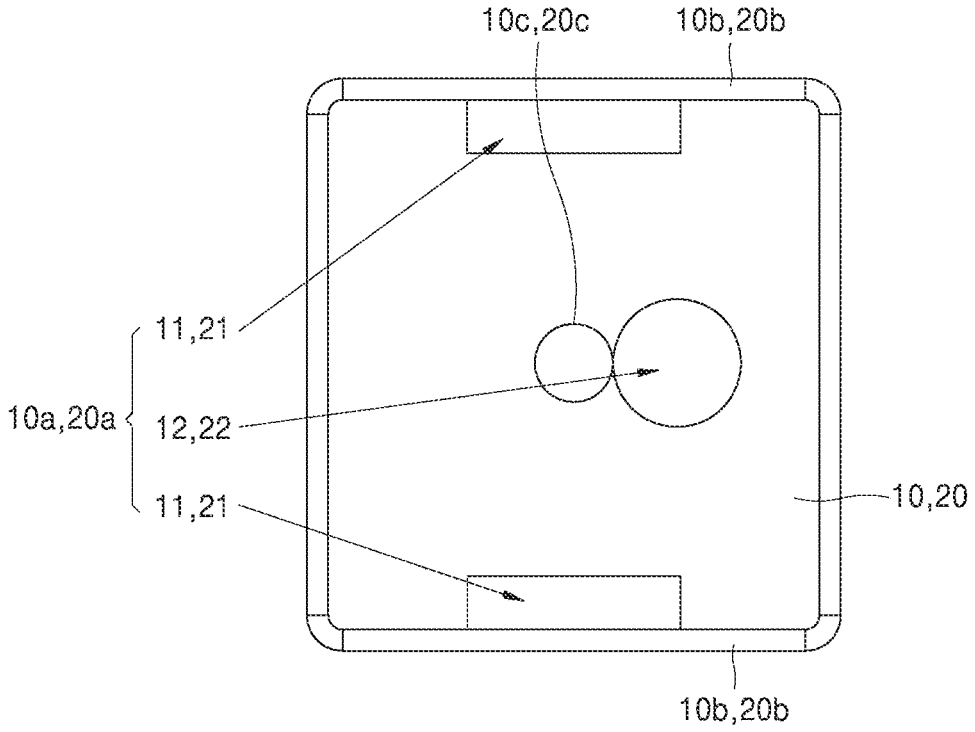
FIG. 1*a* is a top view of a resonant cavity of a dielectric waveguide filter of an embodiment of the present disclosure.
Figure 1B:
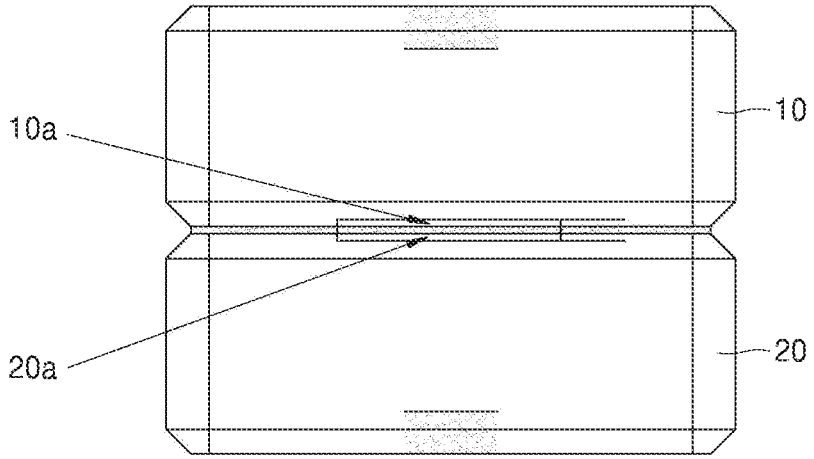
FIG. 1*b* is a partial side view of a dielectric waveguide filter according to various embodiments of the present disclosure.

As shown in FIG. 1*a* and FIG. 1*b*, the present disclosure provides a dielectric waveguide filter, comprising:

a plurality of first resonant cavities 10 and a plurality of second resonant cavities 20, wherein the plurality of first resonant cavities 10 are connected with each other to form upper resonant cavities, the plurality of second resonant cavities 20 are connected with each other to form lower resonant cavities, the upper resonant cavities and the lower resonant cavities are correspondingly overlapped, and each of the plurality of first resonant cavities 10 and each of the plurality of second resonant cavities 20 may have the same structure and shape. Only one of the plurality of first resonant cavities 10 and one of the plurality of second resonant cavities 20 corresponding to each other are shown in FIG. 1*a* and FIG. 1*b*.

Wherein, each of the plurality of first resonant cavities 10 is provided with a first window coupling structure 10*a*, wherein the first window coupling structure 10*a* comprises: a first window 11 opened in a surface of each of the plurality of first resonant cavities 10 at a position where the magnetic field distribution of a first high-order mode in each of the plurality of first resonant cavities 10 is the weakest and the magnetic field of a fundamental mode is the strongest, and/or a second window 12 opened in the surface of each of the plurality of first resonant cavities 10 at a position where the electric field distribution of the first high-order mode in each of the plurality of first resonant cavities 10 is the strongest;

each of the plurality of second resonant cavities 20 is provided with a second window coupling structure 20*a* corresponding to the first window coupling structure 10*a*, wherein, the second window coupling structure 20*a* comprises: a third window 21 opened in a surface of each of the plurality of second resonant cavities 20 at a position where the magnetic field distribution of a first high-order mode in each of the plurality of second resonant cavities 20 is the weakest and the magnetic field of a fundamental mode is the strongest, and/or a fourth window 22 opened in the surface of each of the plurality of second resonant cavities 20 at a position where the electric field distribution of the first high-order mode in each of the plurality of second resonant cavities 20 is the strongest;

wherein, the first window coupling structure 10*a* and the second window coupling structure 20*a* cooperate to eliminate coupling between the first high-order mode in each of the plurality of first resonant cavities 10 and the first high-order mode in each of the plurality of second resonant cavities 20.

In the present embodiment, each resonant cavity of the dielectric waveguide filter has the same structure and shape, and is solid cavity filled with a dielectric such as ceramic, and the surface of each solid cavity is covered with an electromagnetic shielding layer such as a metal layer. In general, each resonant cavity is rectangular or square, thus reducing the coupling of high-order modes in the cavity by a symmetrical structure.

The laminated structure of the upper and lower resonant cavities may isolate the high-order mode in the upper resonant cavities and the high-order mode of the lower resonant cavities, thereby reducing the coupling of the high-order modes between different cavities and realizing the suppression of the high-order modes.

Figure 2A:
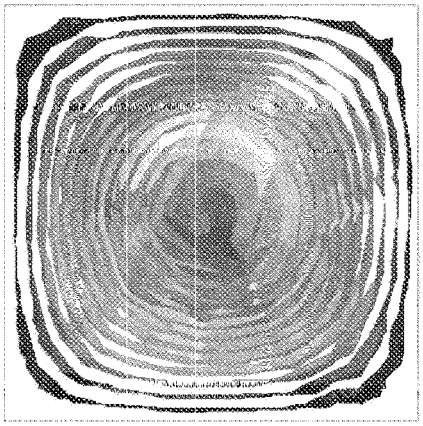
FIG. 2*a*, FIG. 2*b* and FIG. 2*c* are electric field distribution diagrams of a first high-order mode, a second high-order mode and a fundamental mode in a resonant cavity of a dielectric waveguide filter according to various embodiments of the present disclosure.
Figure 2B:
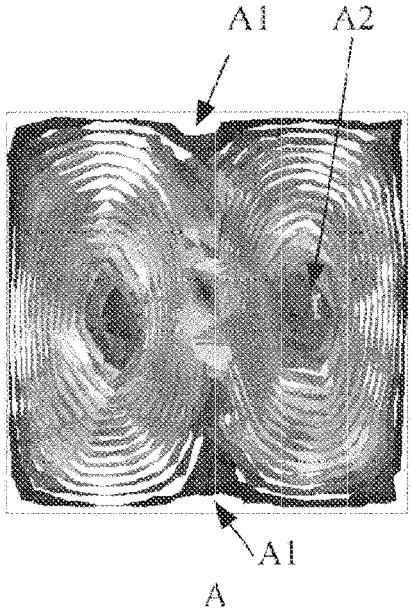
Figure 2C:
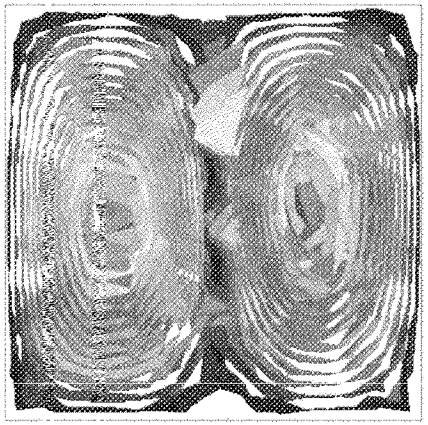

FIG. 2*a*, FIG. 2*b* and FIG. 2*c* show electric field distribution diagrams of a first high-order mode and a second high-order mode and a fundamental mode in each resonant cavity respectively. It can be seen from the figures that the first high-order modes and the second high-order modes are two different high-order modes in a specific embodiment, which can be seen as two different high-order modes with approximately perpendicular directions. The two modes are illustrated herein as mutually perpendicular only, but the case that the first high-order modes and the second high-order modes are not perpendicular to each other is not excluded.

In the dielectric waveguide filter of the present embodiment, the window coupling structures aiming at suppression of the first high-order modes are set, and the window coupling structures consist of first window coupling structures 10*a* arranged in each of the plurality of first resonant cavities 10 and second window coupling structures 20*a* arranged in the corresponding each of the plurality of second resonant cavities 20.

The coupling, between first windows 11 and third windows 21 which are arranged at the positions where the magnetic field distribution in FIG. 2*b* is the weakest (A1) and the magnetic field of the fundamental modes is the strongest, forms magnetic coupling to reduce the magnetic coupling between the first high-order modes of the upper resonant cavities and the lower resonant cavities while ensuring the coupling of the fundamental modes.

The coupling, between second windows 12 and fourth windows 22 corresponding to the positions where the electric field distribution in FIG. 2*b* is the strongest (A2), increases the electrical coupling between the first high-order modes, thereby counteracting the magnetic coupling formed between the first windows 11 and the third windows 21, further reducing the inter-cavity coupling of the first high-order modes inhibiting the transmission of the first high-order modes, and thus achieving the purpose of improving the suppression of the first high-order modes by the filter.

In the present embodiment, strong coupling is formed between the first windows 11 and the third windows 21 which are arranged in pairs, and between the second windows 12 and the fourth windows 22 which are arranged in pairs, thereby realizing the effect of reducing high-order mode coupling. Further, since the positions of the first window coupling structures 10*a* and the second window coupling structures 20*a* correspond to the positions of the electric field and magnetic field distribution intensity of the first high-order modes, the coupling of the first high-order modes may be reduced in a targeted manner.

Further, as shown in FIG. 1*a*, the first window 11 and the second window 12 are located on a first surface of each of the plurality of first resonant cavities 10, and the third window 21 and the fourth window 22 are located on a second surface of each of the plurality of second resonant cavities 20. In this case, the first surface and the second surface are arranged to be opposite to each other. The respective windows of the first window coupling structures 10*a* and the second window coupling structures 20*a* correspond to each other and face each other, thereby forming electrical coupling or magnetic coupling between the upper resonant cavities and the lower resonant cavities.

The windows of the first window coupling structures 10*a* and the second window coupling structures 20*a* herein refer to openings in the electromagnetic shielding layer on the surface of each cavity.

In particular, as shown in FIG. 2*b* and FIG. 1*a*, two of at least one of the first window 11 are located at centers of a pair of opposite edges 10*b* of the first surface of each of the plurality of first resonant cavities 10, and two of at least one of the third window 21 are located at centers of a pair of opposite edges 20*b* of the second surface of the plurality of second resonant cavities 20; and the second window 12 is ¼ of a side length away from the center 10*c* of each of the plurality of first resonant cavities 10, and the fourth window 22 is ¼ of a side length away from the center of each of the plurality of second resonant cavities 20.

As can be seen from the above-described specific embodiment, by arranging the first window coupling structures 10*a* and the second window coupling structures 20*a* corresponding to each other in front of the resonant cavities between adjacent layers, the coupling between the first high-order modes between two resonant cavities connected between adjacent layers may be reduced.

The structure of the plurality of first resonant cavities 10 and the plurality of second resonant cavities 20 serving as an intermediate resonant cavity has been specifically described above. However, if one of the plurality of first resonant cavities 10 or one of the plurality of second resonant cavities 20 is located at the outermost layer and is connected to the input end of the dielectric waveguide filter, as a head resonant cavity or connected to the output end of the dielectric waveguide filter, as a tail resonant cavity, the structure of one of the plurality of first resonant cavities 10 or one of the plurality of second resonant cavities 20 may be further optimized.

Figure 3:
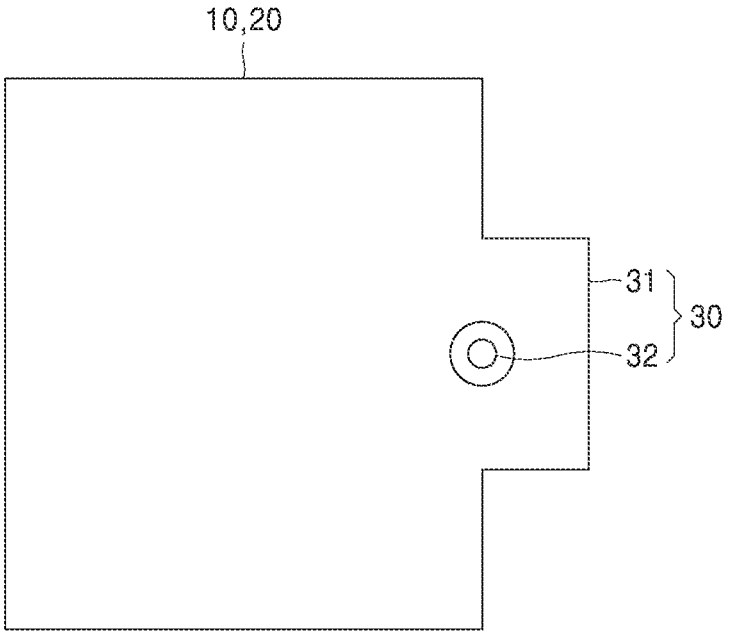
FIG. 3 is a top view of a resonant cavity of a dielectric waveguide filter of another embodiment of the present disclosure.

Specifically, as shown in FIG. 3, the dielectric waveguide filter of the disclosure further comprises a feed structure 30 for reducing the excitation of the second high-order modes, wherein the feed structure 30 comprises a protrusion 31 and a feed post 32.

The protrusion 31 protrudes from one side edge of one of the plurality of first resonant cavities 10 or one of the plurality of second resonant cavities 20 to the outside of one of the plurality of first resonant cavities or one of the plurality of second resonant cavities.

The feed post 32 is arranged at the junction of one of the plurality of first resonant cavities 10 or the junction of one of the plurality of the second resonant cavities 20 and the protrusion 31.

The protrusion 31 protrudes toward the outside of one of the plurality of first resonant cavities 10 or one of the plurality of second resonant cavities 20 to adjust the coupling amount of the plurality of first resonant cavities 10 or the plurality of second resonant cavities 20, and the combination of the protrusion 31 with the feed post 32 may reduce the excitation of the second high-order mode. As can be seen from FIG. 2*c* and FIG. 3, the position of the feed post 32 correspond to the position where the electric field distribution of the second high-order mode is the weakest, so that the excitation of the second high-order mode can be reduced.

In the present embodiment, one of the plurality of first resonant cavities 10 or one of the plurality of second resonant cavities 20 described above serves as the head resonant cavity or the tail resonant cavity, so that when the feed structure 30 is arranged in the head resonant cavity and/or the tail resonant cavity, the excitation of the second high-order mode may be reduced from the source, thereby increasing the suppression of the second high-order mode.

Figure 5:
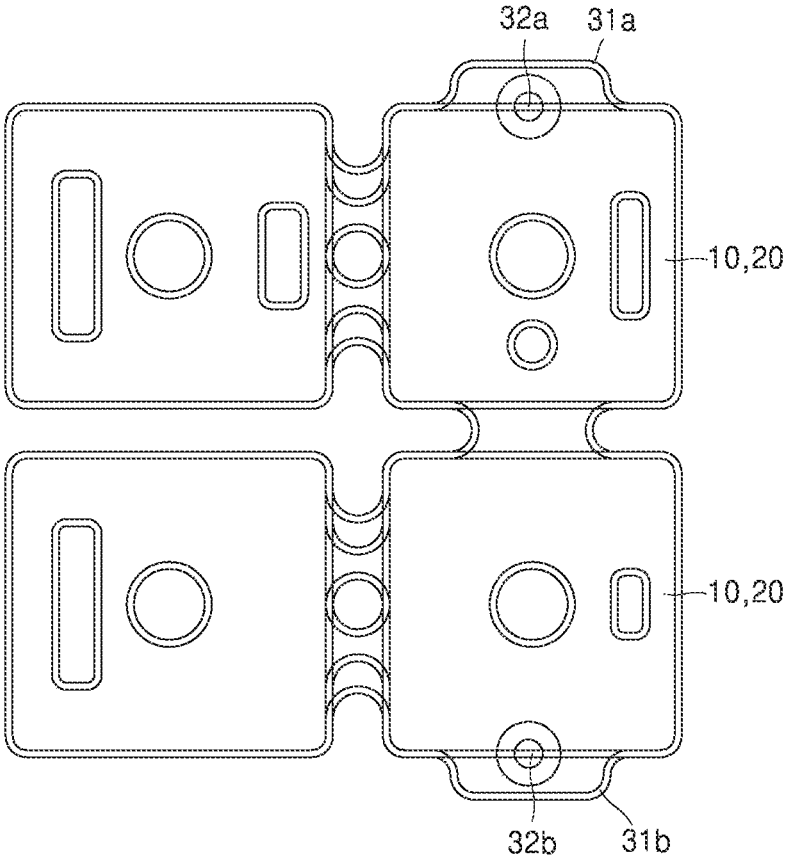
FIG. 5 is a top view of a dielectric waveguide filter of an embodiment of the present disclosure.

Specifically, as shown in FIG. 3 and FIG. 5, the protrusion 31 (FIG. 3) includes, as shown in FIG. 5, a first protrusion 31*a* and a second protrusion 31*b*. The first protrusion 31*a* protrudes from one side edge of one of the plurality of first resonant cavities 10 as an input cavity to the outside of one of the plurality of first resonant cavities. And the second protrusion 31*b* protrudes from one side edge of one of the plurality of second resonant cavities 20 as an output cavity.

In a specific embodiment shown in FIG. 5, the dielectric waveguide filter is provided with eight resonant cavities, including four first resonant cavities 10 as upper resonant cavities and four second resonant cavities 20 as lower resonant cavities. Among the eight resonant cavities, a first resonant cavity 10 in the upper resonant cavities is used as the input cavity and a second resonant cavity 20 in the lower resonant cavities is used as the output cavity. Accordingly, the first protrusion 31*a* is arranged in one of the first plurality of resonant cavities 10 serving as the input cavity and the second protrusion 31*b* is arranged in one of the plurality of second resonant cavities 20 serving as the output cavity. A first feed post 32*a* arranged at the junction of one of the plurality of first resonant cavities 10 and the first protrusion 31*a*, and a second feed post 32*b* arranged at the junction of one of the plurality of second resonant cavities 20 and the second protrusion 31*b* may allow a first feed structure of one of the plurality of first resonant cavities 10 and a second feed structure of one of the plurality of second resonant cavities 20 to be connected by penetrating through one of the first resonant cavities 10 and one of the second resonant cavities 20, and the first feed structure and the second feed structure between two adjacent resonant cavities may be connected through a connecting structure so as to form a through feed structure from the input cavity to the output cavity.

Further, each of the plurality of first resonant cavities 10 is arranged symmetrically based on a center of each of the plurality of first resonant cavities to form the upper resonant cavities, and the plurality of second resonant cavities 20 are arranged in the same manner as the arrangement of the upper resonant cavities to form the lower resonant cavities. Structural symmetry may reduce the coupling of the first high-order mode and the second high-order mode in the same resonant cavity, so as to further improve the far-end suppression effect.

In order to eliminate the coupling of high-order modes more effectively, the structure of two connected adjacent resonant cavities in the same layer may also be optimized.

Figure 4:
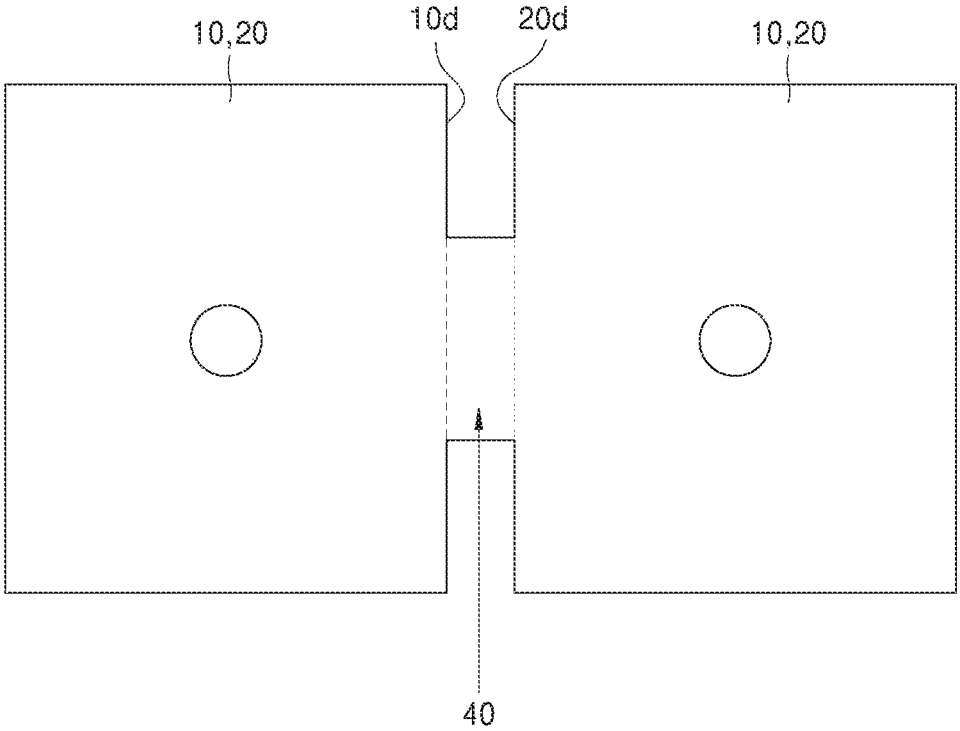
FIG. 4 is a schematic diagram illustrating a connection structure of two resonant cavities of a dielectric waveguide filter according to various embodiments of the present disclosure.

As shown in FIG. 4, the dielectric waveguide filter further comprises:

adjacent cavity coupling spacer 40, the adjacent cavity coupling spacer 40 is connected between two adjacent resonant cavities in the same layer. In a specific embodiment, the adjacent cavity coupling spacer 40 is connected between two adjacent first resonant cavities 10 or between two adjacent second resonant cavities 20, the adjacent cavity coupling spacer 40 is located at the center of a pair of opposite sides 10*d* or 20*d* of the two first resonant cavities 10 or the two second resonant cavities 20, to reduce the coupling of the first high-order modes and the second high-order modes between the two adjacent first resonant cavities 10 or between the two adjacent second resonant cavities 20.

Wherein, the adjacent cavity coupling spacer 40 do not coincide with the first window 11 or the third window 21 in position, that is, the side edges set by the adjacent cavity coupling spacer 40 are different from the pair of side edges set by the first windows 11 and the third windows 21.

Figure 6:
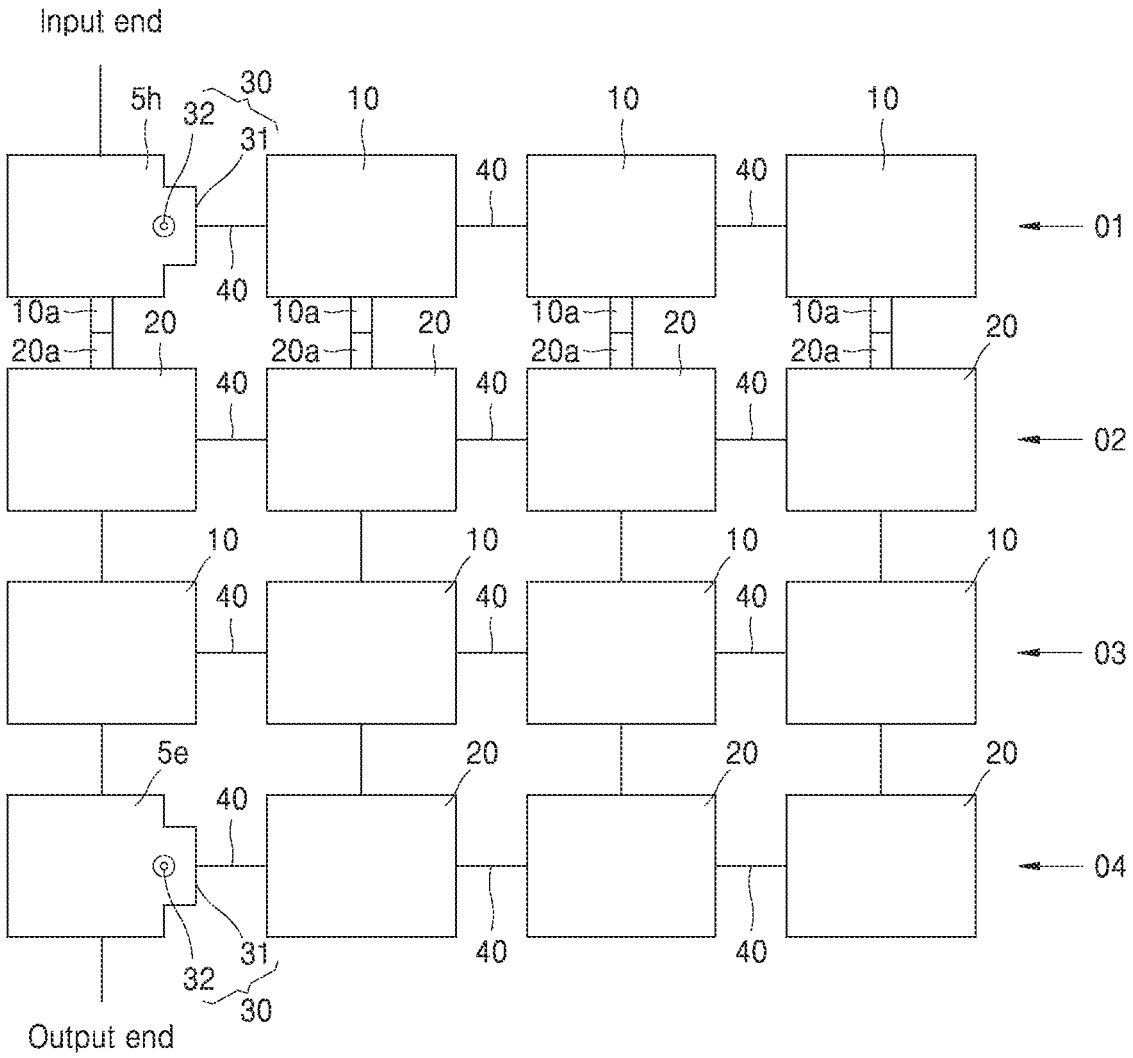
FIG. 6 is a structure schematic diagram of four layers of resonant cavities of a dielectric waveguide filter of a specific embodiment of the present disclosure.

Depending on the specific form of the dielectric waveguide filter, one, two, or three of the window coupling structures formed by the first window coupling structures 10*a* and the second window coupling structures 20*a*, the feed structure 30, and the adjacent cavity coupling spacer 40 may be set selectively. For a dielectric waveguide filter with multiple layers of resonant cavities, the different structures in the embodiments above may be arranged on the resonant cavities at different positions at the same time, and for the entire dielectric waveguide filter, the coupling of high-order modes can be reduced and the suppression of the high-order mode can be improved by combining the three structures above. As shown in FIG. 6, a dielectric waveguide filter with four layers of resonant cavities will be explained as an example.

It should be noted that only the topological structure of a resonant cavity shown in FIG. 6 will be described below. Of course, other topological structures may also be adopted, and the specific structure needs to be determined according to the design requirements of the dielectric waveguide filter.

Specifically, the four layers of resonant cavities include a first layer of resonant cavities 01, a second layer of resonant cavities 02, a third layer of resonant cavities 03 and a fourth layer of resonant cavities 04 from top to bottom, wherein the first layer of resonant cavities 01 include four first resonant cavities 10 which are sequentially connected, the second layer of resonant cavities 02 include four second resonant cavities 20 which are sequentially connected, the third layer of resonant cavities 03 include four first resonant cavities 10 which are sequentially connected, and the fourth layer of resonant cavities 04 include four second resonant cavities 20 which are sequentially connected.

The first layer of resonant cavities 01 and the fourth layer of resonant cavities 04 are located at the outermost layer and are used to connect with the input end and the output end respectively. In this way, the first resonant cavity 10, connected with the input end, in the first layer of resonant cavities 01 is the head resonant cavity 5*h*, and the second resonant cavity 20, connected with the output end, in the fourth layer of resonant cavities 04 is the tail resonant cavity 5*e*. In this way, the feed structure 30 is arranged on the head resonant cavity 5*h* and the tail resonant cavity 5*e*, thereby reducing the excitation of the second high-order modes from the source by using the feed structure 30.

Meanwhile, each first resonant cavities 10 in the first layer of resonant cavities 01, including the resonant cavity serving as the head resonant cavity 5*h*, cooperate with the second resonant cavities 20 in the second layer of resonant cavities 02 located in the middle layer through the window coupling structures formed by the first window coupling structures 10*a* and the second window coupling structures 20*a* in the embodiments above, to eliminate the coupling between the first high-order mode in the first resonant cavities 10 and the first high-order mode in the second resonant cavities 20. Similarly, the cross-layer adjacent resonant cavities between the second layer of resonant cavities 02 and the third layer of resonant cavities 03 as well as the cross-layer adjacent resonant cavities between the third layer of resonant cavities 03 and the fourth layer of resonant cavities 04 are also set the window coupling structures, wherein the fourth layer of resonant cavities 04, including the resonant cavity serving as the tail resonant cavity 5*e*, are also set the window coupling structures. In this way, the coupling between the first high-order modes in the first resonant cavities 10 and the second resonant cavities 20 is eliminated by the window coupling structures described above with respect to FIG. 1*a*.

As shown in FIG. 6, the adjacent cavity coupling spacer 40 is arranged between two of the plurality of first resonant cavities 10 in the same layer or between two of the second resonant cavities 20 in the same layer, thereby reducing the coupling of the first high-order modes and the second high-order modes between two adjacent first resonant cavities 10 or between two adjacent second resonant cavities 20. The adjacent cavity coupling spacer 40 is also arranged between the first resonant cavity 10 serving as the head resonant cavity 5*h* and the adjacent first resonant cavity 10 in the same layer. Similarly, the adjacent cavity coupling spacer 40 is also arranged between the second resonant cavity 20 serving as the tail resonant cavity 5*e* and the adjacent second resonant cavity 20 in the same layer.

From the above analysis, it can be seen that the specific structure of a resonant cavity is related to its specific position and the connection relationship between the resonant cavity and other resonant cavities in the same layer and in adjacent layers.

Of course, there may be only one resonant cavity per layer, so for this topological structure, it is not necessary to arrange the adjacent cavity coupling spacer 40. Meanwhile, when a resonant cavity is not the head resonant cavity 5*h* or the tail resonant cavity 5*e*, it is no need to arrange the feed structure 30.

As can be seen from the embodiments above, in the dielectric waveguide filter provided by the present disclosure, the window coupling structures aiming at the first high-order modes are set, which are composed of the first window coupling structures 10*a* arranged in each first resonant cavity 10 and the second window coupling structures 20*a* arranged in the corresponding second resonant cavities 20, and the first window coupling structures 10*a* and the second window coupling structures 20*a* are coupled to each other, reducing the inter-cavity coupling of the first high-order modes of the two resonant cavities connected between two adjacent layers, so as to realize the suppression of the first high-order modes.

The coupling, between the first windows 11 and the third windows 21 which are arranged at the positions where the magnetic field distribution of the first high-order modes in FIG. 2*b* is the weakest (A1) and the magnetic field of the fundamental modes is the strongest, forms magnetic coupling to reduce the coupling between the first high-order modes of the upper resonant cavities and the lower resonant cavities.

The coupling, between the second windows 12 and the fourth windows 22 corresponding to the positions where the electric field distribution in FIG. 2*b* is the strongest (A2), increases the electrical coupling of the first high-order modes, thereby counteracting the magnetic coupling formed between the first windows 11 and the third windows 21, further reducing the inter-cavity coupling of the first high-order modes, inhibiting the transmission of the first high-order modes, and thus achieving the purpose of improving the suppression of the first high-order modes by the filter.

In the present disclosure, the first windows 11 and the third windows 21 which are arranged in pairs may reduce the coupling between the high-order modes while maintaining the coupling of the main modes. Further, since the positions of the first window coupling structures 10*a* and the second window coupling structures 20*a* correspond to the positions of the distribution intensity of the electric field and the magnetic field of the first high-order modes, thus the coupling of the first high-order modes may be reduced in a targeted manner.

The feed structure 30 of the present disclosure reduces the excitation of the second high-order modes from the source, thereby increasing the suppression of the second high-order modes. The adjacent cavity coupling spacer 40 may reduce the coupling between the first high-order modes and the first high-order modes between two adjacent resonant cavities in the same layer.

Further, the combination of the feed structure 30, the window coupling structures formed by the first window coupling structures 10*a* and the second window coupling structures 20*a*, and the adjacent cavity coupling spacer 40 may suppress the first high-order modes and the second high-order modes simultaneously, so that the suppression of the high-order modes may be comprehensively improved and the harmonic frequency of the dielectric waveguide filter may be pushed farther.

Each of the plurality of first resonant cavities 10 is arranged symmetrically based on a center of each of the plurality of first resonant cavities to form the upper resonant cavities, and the plurality of second resonant cavities 20 are arranged in the same manner as the arrangement of the upper resonant cavities to form the lower resonant cavities. Structural symmetry may reduce the coupling of the first high-order mode and the second high-order mode in the same resonant cavity, so as to further improve the far-end suppression effect.

The foregoing embodiments are only preferable embodiments of the present disclosure and are not for limiting the present disclosure. Any modifications, equivalent substitutions, improvements and the like in accordance with the spirit and principles of the present disclosure should fall within the protection scope of the present disclosure.

The invention claimed is:

1. A dielectric waveguide filter, comprising:

a plurality of first resonant cavities and a plurality of second resonant cavities, wherein the plurality of first resonant cavities are connected to form upper resonant cavities, and the plurality of second resonant cavities are connected to form lower resonant cavities, wherein each of the plurality of first resonant cavities has a respective first window coupling structure, wherein the respective first window coupling structure comprises at least one of a first window opened in a respective surface of each of the plurality of first resonant cavities and a respective second window opened in the respective surface of each of the plurality of first resonant cavities, wherein each of the plurality of second resonant cavities has a respective second window coupling structure positioned to be corresponding to the first window coupling structure, wherein the respective second window coupling structure comprises at least one of a third window opened in a respective surface of each of the plurality of second resonant cavities and a fourth window opened in the respective surface of each of the plurality of second resonant cavities, wherein the first window is opened in the respective surface of each of the plurality of first resonant cavities at a position where the magnetic field distribution of a first high-order mode in each of the plurality of first resonant cavities is the weakest, and the respective second window is opened in the surface of each of the plurality of first resonant cavities at a position where the electric field distribution of the first high-order mode in each of the plurality of first resonant cavities is the strongest, and wherein the third window is opened in the respective surface of each of the plurality of second resonant cavities at a position where the magnetic field distribution of a first high-order mode in each of the plurality of second resonant cavities is the weakest, and the fourth window is opened in the surface of each of the plurality of second resonant cavities at a position where the electric field distribution of the first high-order mode in each of the plurality of second resonant cavities is the strongest.

2. The dielectric waveguide filter according to claim 1, wherein the upper resonant cavities and the lower resonant cavities are correspondingly overlapped.

3. The dielectric waveguide filter according to claim 1, wherein the respective first window coupling structure and the respective second window coupling structure cooperate to eliminate coupling between the first high-order mode in each of the plurality of first resonant cavities and the first high-order mode in each of the plurality of second resonant cavities.

4. The dielectric waveguide filter according to claim 1, wherein a first feed post arranged at a junction of one of the plurality of first resonant cavities and a first protrusion of one of the plurality of first resonant cavities, and a second feed post arranged at a junction of one of the plurality of second resonant cavities and a second protrusion of one of the plurality of second resonant cavities allow a first feed structure of one of the plurality of first resonant cavities and a second feed structure of one of the plurality of second resonant cavities to be connected by penetrating through one of the first resonant cavities and one of the second resonant cavities.

5. The dielectric waveguide filter according to claim 1, wherein each of the plurality of first resonant cavities is arranged symmetrically based on a center of each of the plurality of first resonant cavities to form the upper resonant cavities, and wherein the plurality of second resonant cavities are arranged in the same manner as the arrangement of the upper resonant cavities to form the lower resonant cavities.

6. The dielectric waveguide filter according to claim 1, wherein each resonant cavity of the dielectric waveguide filter is a respective cavity filled with a solid dielectric.

7. The dielectric waveguide filter according to claim 1, wherein at least one of the first window and the second window are located on the respective surface of each of the plurality of first resonant cavities, wherein at least one of the third window and the fourth window are located on the surface of each of the plurality of second resonant cavities, and wherein the respective first surface and the respective second surface are arranged to be opposite to each other.

8. The dielectric waveguide filter according to claim 7, wherein two of at least one of the first window are located at centers of a pair of opposite edges of the first surface of each of the plurality of first resonant cavities, respectively, and two of at least one of the third window are located at centers of a pair of opposite edges of the second surface of each of the plurality of second resonant cavities, respectively; and wherein the respective second window is ¼ of a side length away from the center of each of the plurality of first resonant cavities, and the respective fourth window is ¼ of a side length away from the center of each of the plurality of second resonant cavities.

9. The dielectric waveguide filter according to claim 1, further comprising a feed structure for reducing excitation of a second high-order mode wherein the feed structure comprises a protrusion protruding from one side edge of one of the plurality of first resonant cavities or one of the plurality of second resonant cavities and a feed post arranged at a junction of one of the plurality of first resonant cavities or a junction of one of the plurality of second resonant cavities and the protrusion.

10. The dielectric waveguide filter according to claim 1 further comprising:

an adjacent cavity coupling spacer connected between two adjacent ones of the plurality of first resonant cavities or between two adjacent ones of the plurality of second resonant cavities.

11. The dielectric waveguide filter according to claim 10, wherein the adjacent cavity coupling spacer is located at a center of a pair of opposite sides of the two adjacent ones of the plurality of first resonant cavities or the two adjacent ones of the plurality of second resonant cavities to reduce the coupling of the first high-order modes and a second high-order modes between the two adjacent ones of the plurality of first resonant cavities or between the two adjacent ones of the plurality of second resonant cavities.

12. The dielectric waveguide filter according to claim 10, wherein the adjacent cavity coupling spacer does not coincide in position with the respective first windows or the respective third windows in position.

* * * * *